US009295341B2

(12) United States Patent
Sonnenberg

(10) Patent No.: US 9,295,341 B2
(45) Date of Patent: Mar. 29, 2016

(54) CONVERTIBLE BAG AND CHILD CARRIER

(76) Inventor: Heather Sonnenberg, Redondo Beach, CA (US)

( * ) Notice: Subject to any disclaimer, the term of this patent is extended or adjusted under 35 U.S.C. 154(b) by 111 days.

(21) Appl. No.: 13/355,409

(22) Filed: Jan. 20, 2012

(65) Prior Publication Data

US 2012/0187173 A1 Jul. 26, 2012

Related U.S. Application Data

(60) Provisional application No. 61/434,756, filed on Jan. 20, 2011.

(51) Int. Cl.
*A45C 9/00* (2006.01)
*A47D 13/02* (2006.01)

(52) U.S. Cl.
CPC .. *A47D 13/02* (2013.01); *A45C 9/00* (2013.01)

(58) Field of Classification Search
CPC ..... A47D 13/02; A47D 13/025
USPC ..... 224/158–160, 575–577, 581
See application file for complete search history.

(56) References Cited

U.S. PATENT DOCUMENTS

| | | | | |
|---|---|---|---|---|
| 3,841,543 | A * | 10/1974 | Bolton | 224/158 |
| 4,483,469 | A * | 11/1984 | Arisland | 224/582 |
| 4,757,925 | A * | 7/1988 | Knittel | 224/158 |
| 7,389,897 | B2 * | 6/2008 | Pistiolis et al. | 224/158 |
| 2003/0024960 | A1 * | 2/2003 | Greenstein et al. | 224/153 |
| 2008/0134408 | A1 * | 6/2008 | Kantor | 2/102 |
| 2008/0149674 | A1 * | 6/2008 | Hiniduma-Lokuge | 224/159 |

* cited by examiner

*Primary Examiner* — Adam Waggenspack
(74) *Attorney, Agent, or Firm* — West & Associates, A PC; Stuart J. West; Shaun N. Sluman

(57) ABSTRACT

A convertible bag with storage compartments, pockets, and bottle compartments for carrying diapers, bottles, childcare supplies, or other general items. The bag can convert into a sling for carrying a child. The storage compartments, pockets, and bottle compartments of the convertible bag can still be accessed by a user even when a child is being carried in the converted sling configuration.

18 Claims, 9 Drawing Sheets

CONVERTIBLE BAG AND CHILD CARRIER

CROSS-REFERENCE TO RELATED APPLICATIONS

This application claims the benefit of priority to prior filed U.S. Provisional Patent Application No. 61/434,756, filed Jan. 20, 2011, the complete contents of which are hereby incorporated by reference.

BACKGROUND

1. Field of the Invention

The present disclosure relates to the field of childcare accessories, specifically a bag that can be converted to a child carrier.

2. Background

Caring for children, including infants, toddlers, and other young children can be challenging whether a parent or guardian is at home or in a public place. However, being away from home while travelling, shopping, eating in restaurants, or being in other public venues can present a parent or guardian with the problem of having too many things to carry around in addition to needing to carry a child. Carrying around diapers, bottles, changing pads, wipes, toys, keys, wallets, cash, identification, credit cards, mobile phones, and/or other items while also holding a child can be difficult, especially when disorganization arises and it is difficult to reach needed items while caring for the child. Currently, there are both baby carriers and diaper bags on the market. However, there has not been a product that can serve both functions at a user's whim.

What is needed is a diaper bag that can hold all of one's essentials, but can also convert to a child carrier when needed. The device should allow all storage compartments and accessories of the diaper bag to remain readily accessible when the device is converted and is being used to carry a child. The device should also be able to be used as a stand-alone bag when not caring for a child or not using the bag as a diaper bag. The device should have a removable handle or strap that can be detached and stored when the device is being used to carry a child, such that there is no extra material that might get in the way between the device and the child.

DETAILED DESCRIPTION

Figure 1:
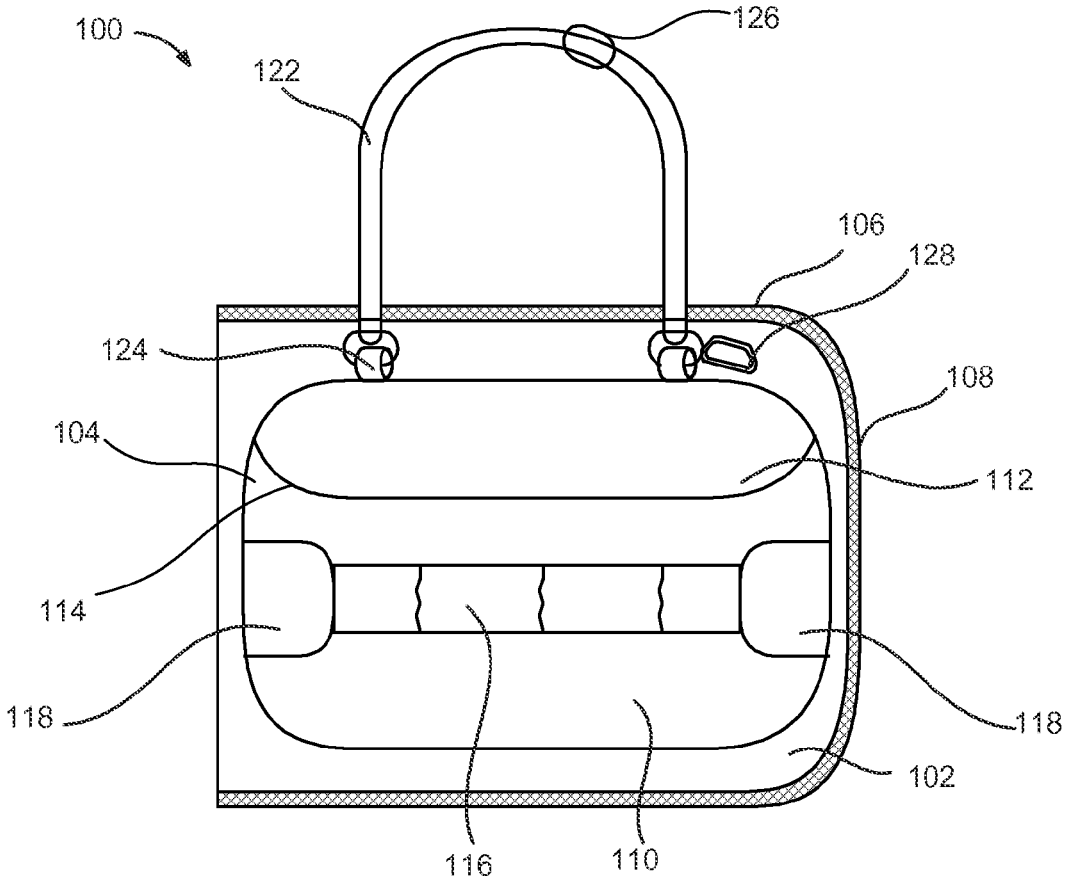
FIG. 1 depicts a front view of one embodiment of a convertible bag.
Figure 2:
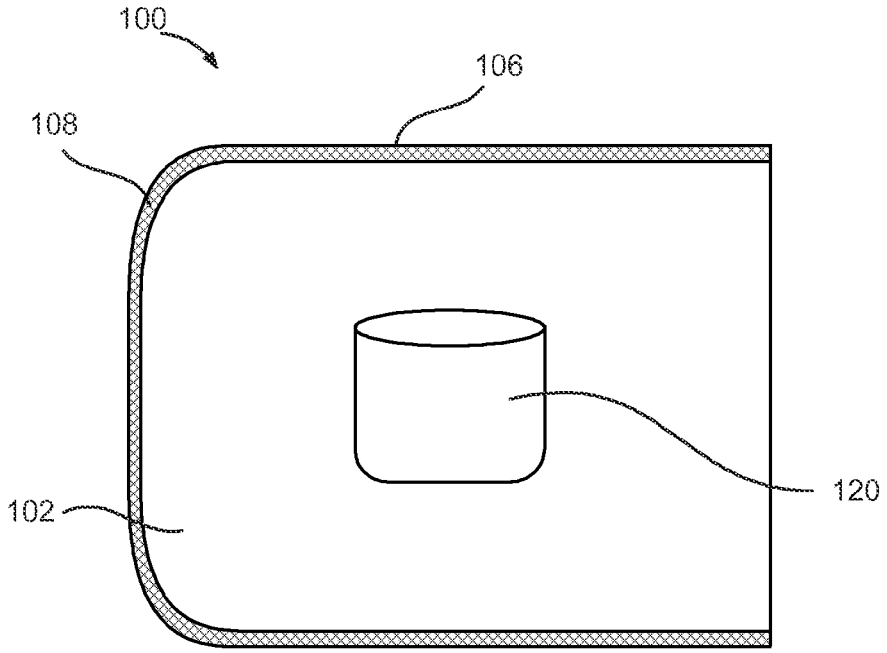
FIG. 2 depicts a back view of same embodiment of the convertible bag.
Figure 5:
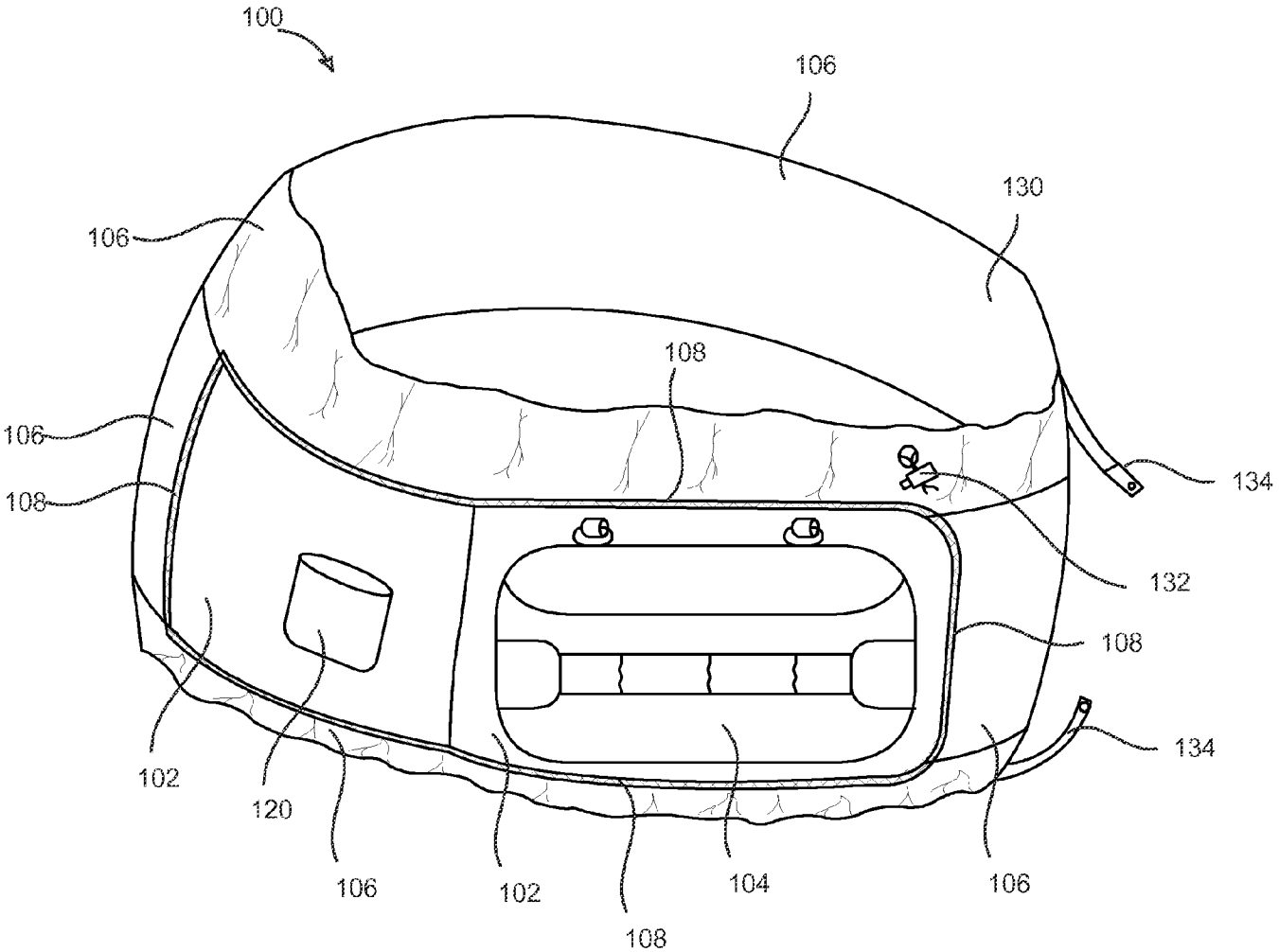
FIG. 5 depicts a convertible bag in an open, extended, child carrier configuration.
Figure 6:
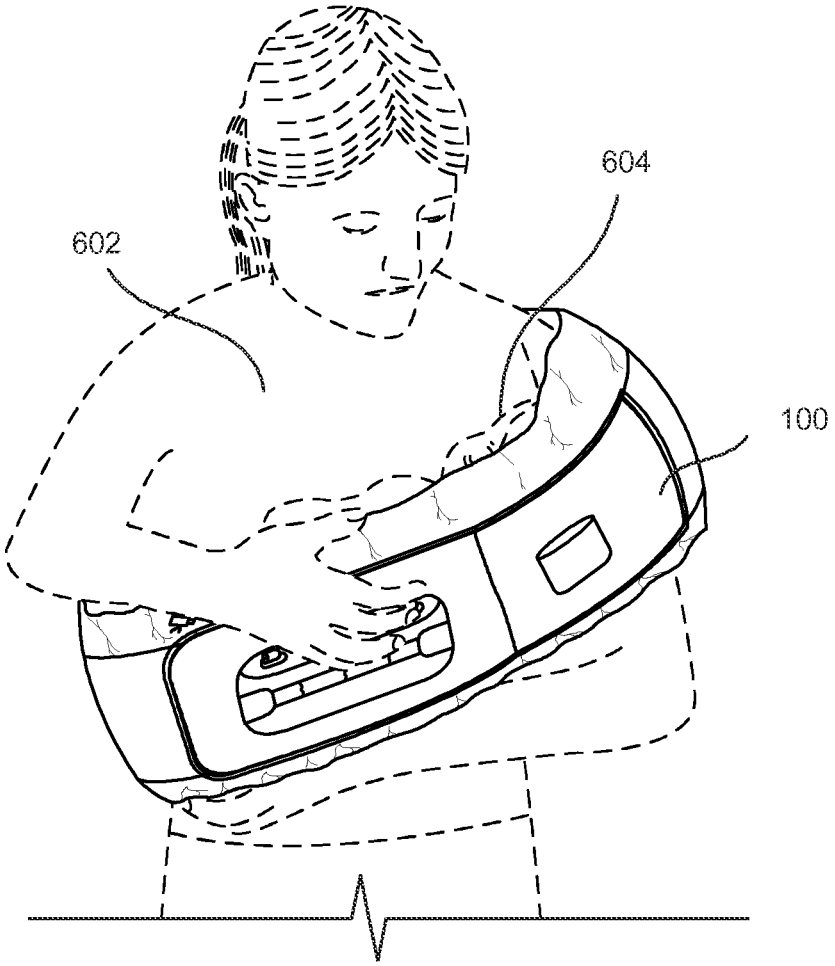
FIG. 6 depicts one embodiment of a convertible bag and child carrier in use with a child in a cradle position.
Figure 7:
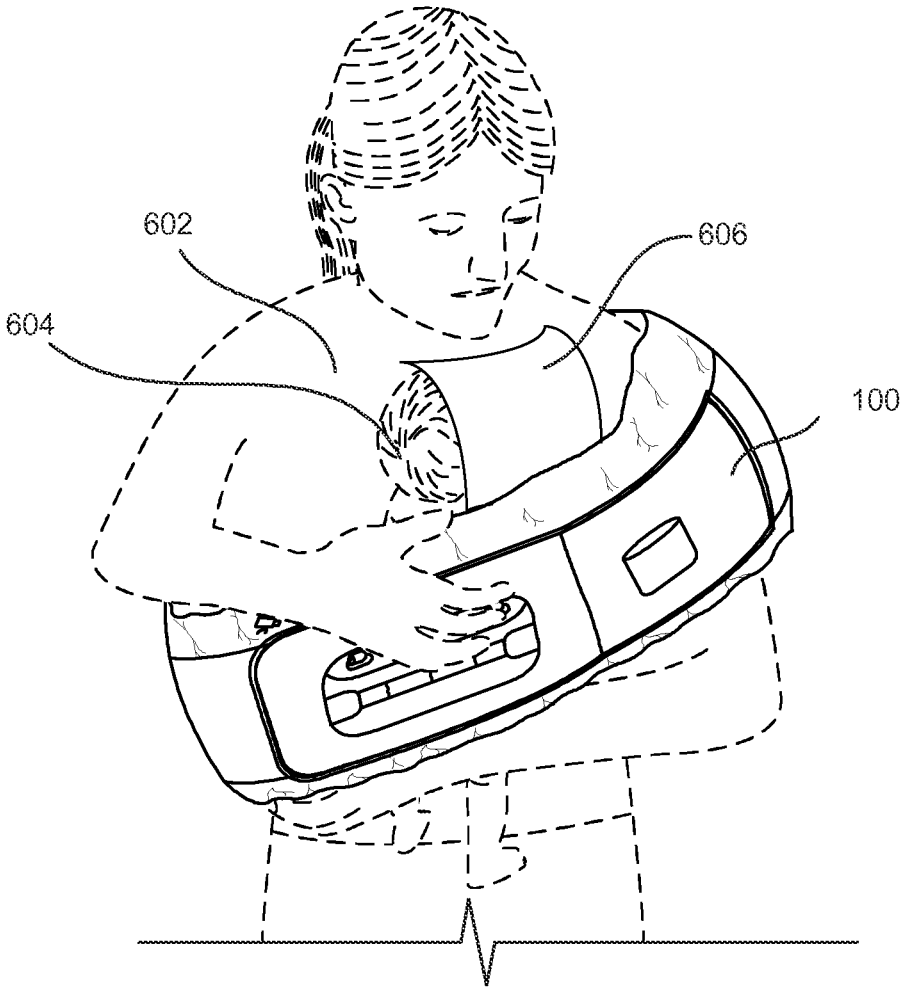
FIG. 7 depicts another embodiment of a convertible bag and child carrier in use with a child in a sitting position.

FIG. 1 depicts a convertible bag 100. The convertible bag 100 can comprise one or more body portions 102, one or more storage portions 104, and one or more child carrier portions 106. The convertible bag 100 can have a closed position in which the body portions 102 enclose the child carrier portions 106, as shown in FIGS. 1 and 2. The convertible bag 100 can also have an open position in which the child carrier portions 106 are not enclosed by the body portions 102 and the convertible bag 100 can be used as a child sling and/or carrier, as shown in FIGS. 5-7.

In the closed position, the convertible bag 100 can have a front, as shown in FIG. 1, and a back, as shown in FIG. 2. In some embodiments, the convertible bag 100 can also have one or more sides, a top, and/or a bottom that can extend between the front and the back of the convertible bag 100. The front, back, sides, top, and/or bottom of the convertible bag 100 can comprise one or more body portions 102. In some embodiments, the convertible bag 100 can comprise a single body portion 102 that is large enough to extend from the front of the convertible bag 100 to the back of the convertible bag 100. By way of a non-limiting example, a single body portion 102 can be folded, tucked, segmented, or bent into at least two sections such that one section of the body portion 102 is the front of the convertible bag and the other section of the bottom portion is the back of the convertible bag, as shown in FIGS. 1 and 2. In alternate embodiments, the front of the convertible bag 100 can comprise one body portion 102 and the back of the convertible bag 100 can comprise a separate body portion 102. In still other embodiments, the front, back, top, bottom and/or sides of the convertible bag 100 can each comprise any number of body portions 102 coupled with one another in any configuration. In some embodiments of the convertible bag 100 that comprise a plurality of body portions, the body portions can be coupled with one another directly through stitching, adhesives, fusing, or any other connection method. In other embodiments of the convertible bag 100 that comprise a plurality of body portions 102, the body portions 102 can be coupled with one another via intermediate portions comprised of fabric, plastic, polymer, nylon, elastomeric material, metallic thread, or any other known and/or convenient material or combination of materials.

In some embodiments, the body portions 102 can be substantially rectangular. In alternate embodiments, the body portions 102 can be circular, square, ovoid, irregular in shape, and/or can have any other known and/or convenient geometry. In some embodiments, the body portions 102 can be at least partially comprised of fabric. In other embodiments the body portions 102 can be at least partially comprised of plastic, polymer, nylon, elastomeric material, metallic thread, and/or any other known and/or convenient material or combination of materials. In some embodiments, the body portions 102 can be comprised of hypo-allergenic, anti-bacterial, anti-fungal, waterproof, breathable, sun resistant, and/or water resistant material. In some embodiments, the body portions 102 can be at least partially comprised of impermeable material, such that liquid cannot pass through the body portions 102. The body portions 102 can be machine washable and/or insulated. The body portions 102 can comprise one or more colors, prints, designs, and/or embellishments.

The front and back of the convertible bag 100 can be permanently coupled with one another along one side, and selectively coupled with one another on the remaining sides via closure mechanisms 108 to form the convertible bag 100 into the closed position. In some embodiments, the closure mechanisms 108 can be one or more zippers. By way of a non-limiting example, in the embodiment shown in FIGS. 1 and 2, the front and back of the convertible bag 100 are permanently coupled with one another along one side (the left side as seen in FIG. 1 and the right side as seen in FIG. 2), and are selectively coupled with one another along the top, opposing side, and bottom via a zipper. In alternate embodiments, the closure mechanisms 108 can be hook and loop fasteners, snaps, buttons, magnets, and/or any other convenient and/or desired closure mechanism.

In some embodiments, one or more storage portions 104 can be coupled with the convertible bag 100. A storage portion 104 can comprise one or more storage compartments 110 and one or more access sections 112. A storage compartment 110 can be a pouch, box, pocket, case, or any other type of compartment. An access section 112 can be a flap, slit, or any other mode of accessing a storage compartment 110. In some embodiments, the storage compartment 110 and/or the access section 112 can comprise one or more fastening components 114 that can be selectively engaged to close the storage portion 104. In some embodiments, the fastening components 114 can be complementary hook and loop fasteners. In other embodiments, the fastening components 114 can be snaps, hook and eye fasteners, buttons, magnets, zippers, or any other known and/or convenient fastening mechanism. The storage portion 104 can be coupled with the convertible bag 100 at any location on the convertible bag 100. By way of a non-limiting example, the storage portion 104 can be coupled with front of the convertible bag 100, as shown in FIG. 1. In some embodiments, the storage portion 104 can be coupled with the convertible bag 100 permanently via stitching, adhesives, or any other desired mechanism. In alternate embodiments, the storage portion 104 can be removable and can be selectively coupled with the convertible bag 100 temporarily via snaps, buttons, hook and loop fasteners, or any other desired selective coupling mechanism.

Figure 3:
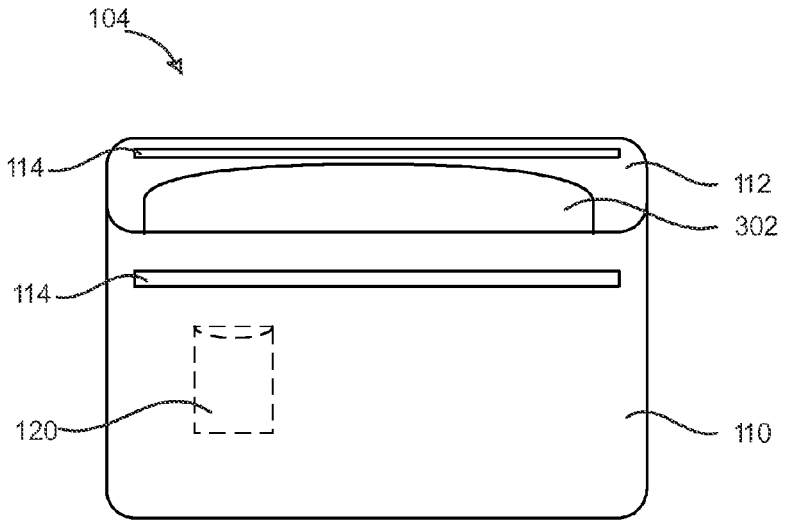
FIG. 3 depicts a front view of a storage portion without a bottle compartment in an open position.

FIG. 3 depicts an embodiment of a storage portion 104 in a configuration with an access section 112 open such that the interior of the storage compartment 110 can be accessed. In some embodiments, a storage compartment 110 can be sized such that it can store a diaper changing pad 302, as shown in FIG. 3. In other embodiments, the storage compartment 110 can be sized such that it can store baby wipes, diapers, toys, clothing, medications, books, and/or any other item or group of items. The access section 112 can be secured to the storage compartment 110 with the fastening components 114. By way of a non-limiting example, the fastening components 114 shown in FIG. 3 are corresponding strips of hook and loop fasteners coupled with the access section 112 and the storage compartment 110.

Figure 4:
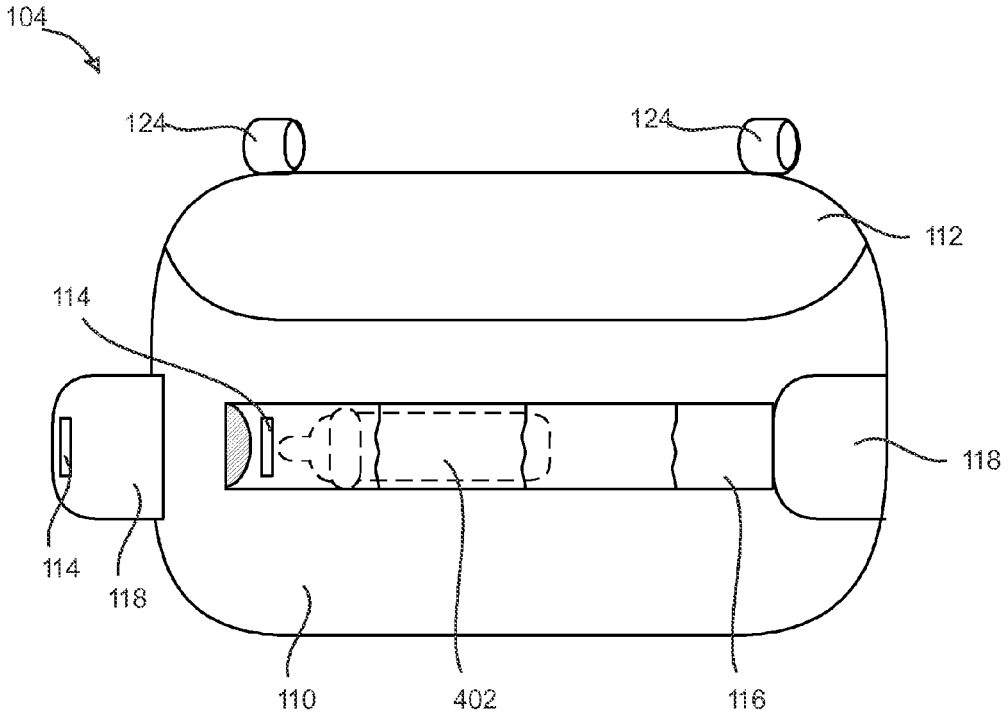
FIG. 4 depicts a front view of a storage portion with a bottle compartment.

FIG. 4 depicts an embodiment of the storage portion 104 comprising a bottle compartment 116. In some embodiments one or more bottle compartments 116 can be coupled with the convertible bag 100. In some embodiments, one or more bottle compartments 116 can be coupled with the storage portion 104, as shown in FIGS. 1 and 4. In other embodiments, one or more bottle compartments 116 can be coupled with one or more body portions 102 at any location on the convertible bag 102. In some embodiments, a bottle compartment 116 can be a substantially horizontal tubular pathway configured to accommodate one or more baby bottles 402 and/or other desired objects, as shown in FIG. 4. In alternate embodiments, the bottle compartment 116 can be vertical or can be oriented in any other direction. In some embodiments, a bottle compartment 116 can comprise flaps 118 at one or both ends of the tubular pathway to enclose the bottle compartment 112. In some embodiments, the flaps 118 can be selectively coupled with the bottle compartment 116 via fastening components 114 to enclose the bottle compartment 116. In some embodiments, the bottle compartment 116 can be coupled with the convertible bag 100 permanently via stitching, adhesives, or any other desired mechanism. In alternate embodiments, the bottle compartment 116 can be removable and can be selectively coupled with the convertible bag 100 temporarily via snaps, buttons, hook and loop fasteners, or any other desired selective coupling mechanism.

The bottle compartments 116 and the flaps 118 can be comprised of the same material as the body portions 102 and/or storage portions 104, or can be comprised of a different material. In some embodiments, the bottle compartments 116 can be insulated via insulating layers or inherently insulating material such as foam, rubber, polystyrene, neoprene, or other insulating material to assist in keeping baby formula, breast milk, food, or other items at proper temperatures.

In some embodiments, the convertible bag 100 can comprise one or more pockets 120. The pockets 120 can have any desired dimensions. Pockets 120 can be configured to hold a mobile phone, personal computing device, keys, wallet, credit cards, cash, toys, pacifiers, jewelry and/or any other desired items. A pocket 120 can be located at any position on the convertible bag 100, such as on a body portion 102 or on the exterior or interior of a storage portion 104. By way of a non-limiting example, FIG. 2 depicts a pocket 120 coupled with the body portion 102 on the back of the convertible bag 100. By way of another non-limiting example, FIG. 3 depicts a pocket 120 coupled with the interior of the storage compartment 110 such that the pocket 120 and the contents of the pocket 120 cannot be seen from outside the convertible bag 100. In some embodiments, the pockets 120 can be closed and/or fastened with fastening components 114 such that the contents of the pocket 120 can be secured inside the pocket 120 until the pocket 120 is opened or unfastened. In some embodiments, one or more pockets 120 can be selectively removable from the convertible bag 100. The pockets 120 can be removably coupled with the body portions 102 via hook and loop fasteners, snaps, buttons, zippers, clips, magnets and/or any other convenient mechanism. In alternate embodiments, the pockets 120 can be permanently coupled with the body portions 102 via stitching, adhesives, or any other attachment mechanism.

One or more handles 122 can be coupled with the convertible bag 100. In some embodiments, the convertible bag 100 can comprise rings 124 and the handles 122 can be removably coupled with the rings 124, such that the handles 122 can be detached from the convertible bag 100 and optionally stored in a storage compartment 110. The rings 124 can be fabric loops, metal rings, plastic rings, or any other type of ring or loop. In alternate embodiments, the handles 122 can be permanently coupled with the convertible bag 100 and/or the loops 124 via stitching, adhesives, fusing, or any other attachment mechanism. In some embodiments, the handles 122 can be coupled with a storage portion 104. In alternate embodiments, the handles 122 can be coupled with one or more of the front, back, sides, and/or top of the convertible bag 100. By way of a non-limiting example, the handle 122 depicted in FIG. 1 can be coupled with the storage portion 104. In some embodiments, the handles 122 can have an adjustable length via one or more rings 126. In some embodiments, the handles 122 can have a fixed length suitable for wearing the handles 122 over a user's shoulder. In other embodiments, the handles 122 can have a fixed length suitable for carrying the handles 122 by hand. The handles 106 can be comprised of fabric, nylon, polymer, elastomeric material, non-slip material, breathable material, mesh material, and/or any other desired material or combination of materials.

In some embodiments, one or more carabiners 128 can be selectively coupled with the handles 122 and/or the rings 124. In other embodiments, the carabiners 128 can be selectively coupled with any other desired portion of the convertible bag 100. In operation, the carabiners 128 can be used to attach keys, accessories, toys, pacifiers, rattles or other items to the convertible bag 100.

Figure 10:
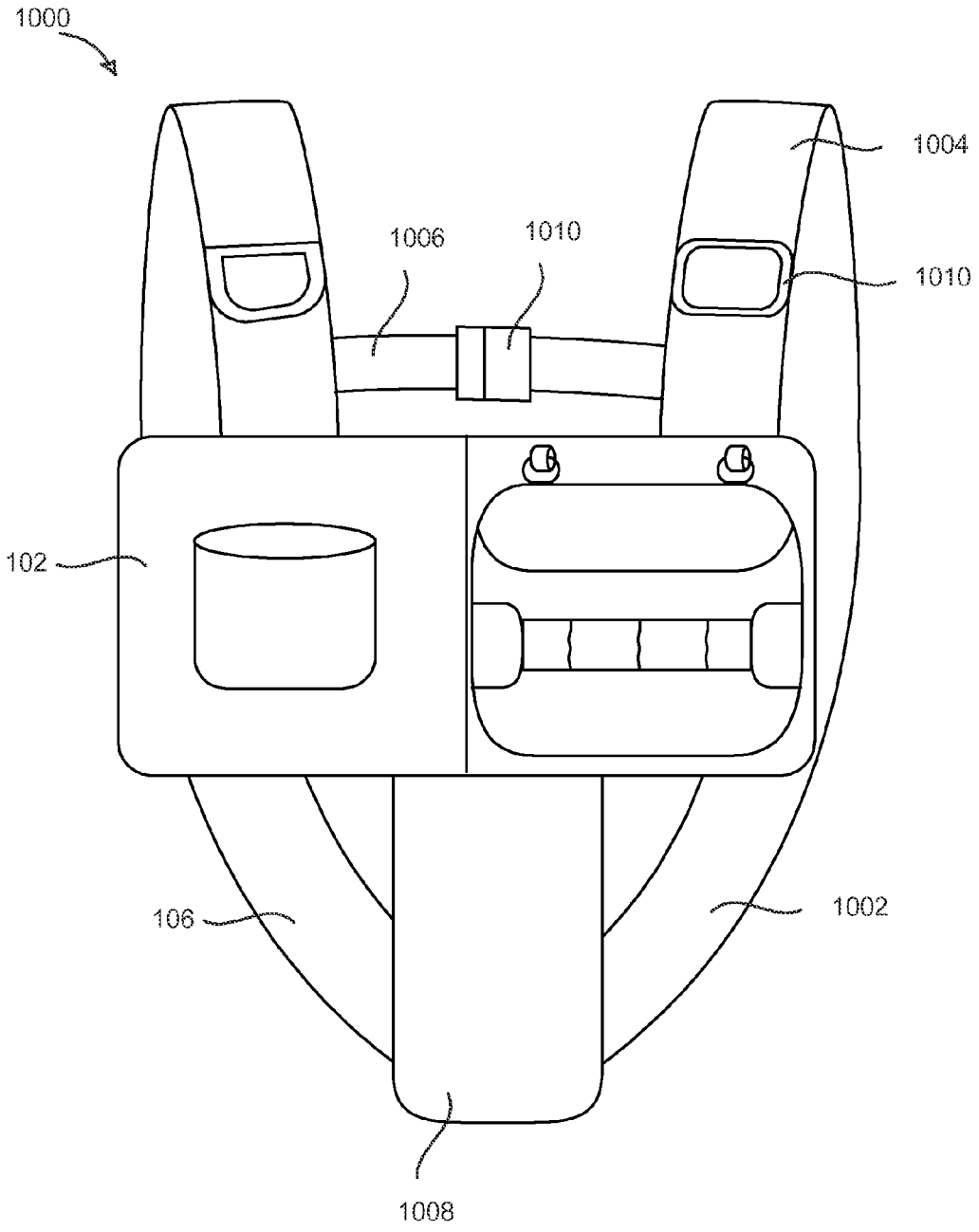
FIG. 10 depicts an embodiment of a convertible bag that forms a front style child carrier in an open position.
Figure 11:
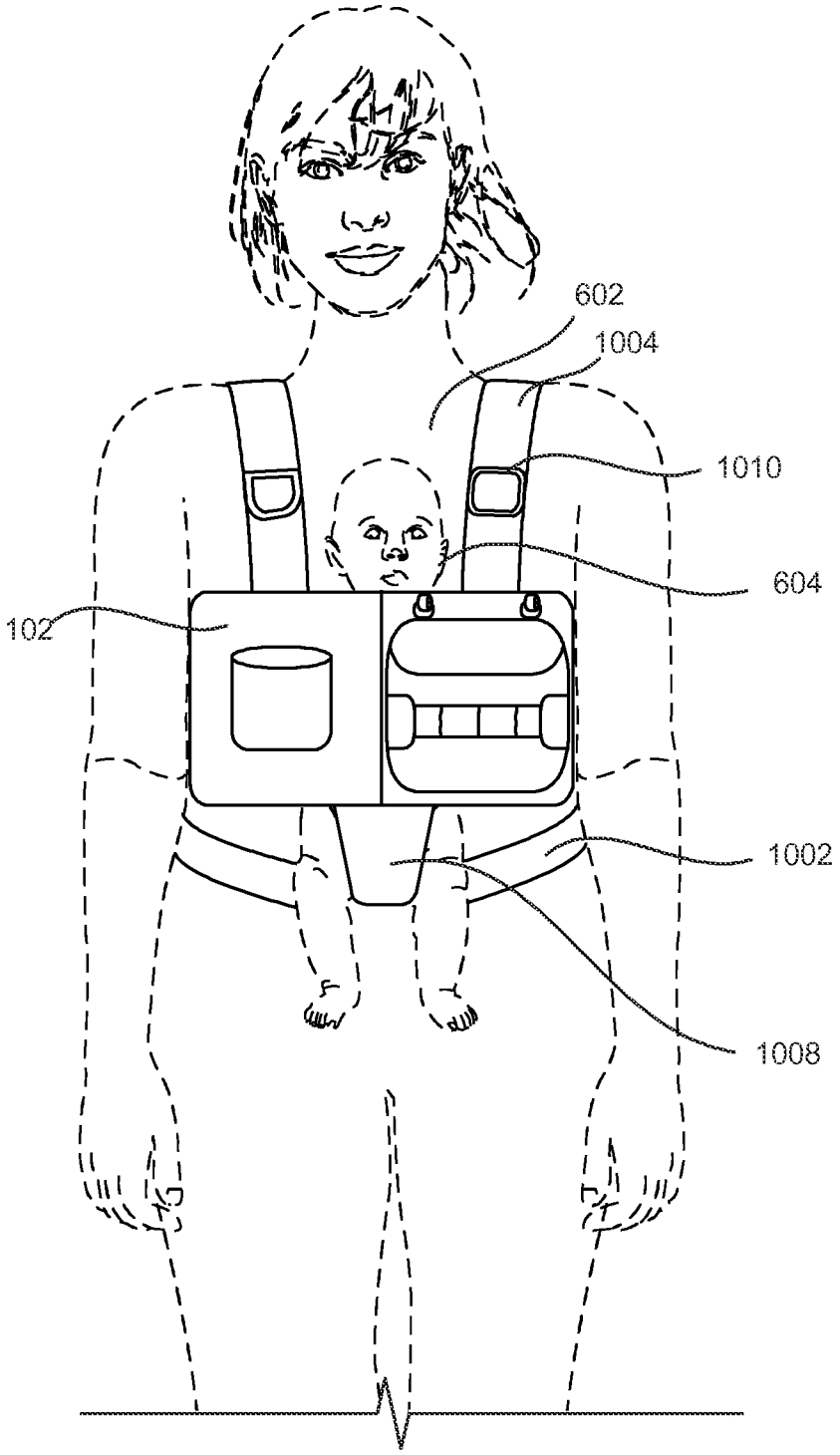
FIG. 11 depicts an embodiment of a convertible bag that forms a front style child carrier in use.

FIG. 5 depicts the convertible bag 100 in one embodiment of an open position such that the one or more child carrier portions 106 are not enclosed by the body portions 102. In some embodiments, in the open position the body portions 102 and/or the child carrier portions 106 can form a sling type child carrier, as shown in FIGS. 5-9. In other embodiments, in the open position the body portions and/or the child carrier portions 106 can form a front style child carrier, as shown in FIGS. 10 and 11. In still other embodiments, in the open position the body portions 102 and/or the child carrier portions 106 can form any other style, form, or type of child carrier, such as a wrap, sling, backpack, harness, papoose, or other child carrier.

Referring back to FIG. 5, the body portions 102 and/or the child carrier portions 106 can form a loop 130 that can be worn by a user as a sling type child carrier, as shown in FIGS. 6 and 7. In some embodiments, some segments of the loop 130 can be wider than other segments of the loop 130. In other embodiments, the loop 130 can have a uniform width at each segment around the circumference of the loop 130. The loop 130 can have a circumference such that a user can surround his or her upper torso with the loop 130 so that the loop 130 is positioned diagonally across the user's chest from a shoulder to the waist. In some embodiments, the loop 130 can have a fixed circumference. In other embodiments, the loop 130 can comprise one or more adjustment mechanisms 132 that a user can operate to change the circumference of the loop 130 to fit the user's body size. In some embodiments, the adjustment mechanisms 132 can be one or more elastic cords with toggles. In alternate embodiments, the adjustment mechanisms 132 can be adjustable straps. In still other embodiments, the adjustment mechanisms 132 can be hook and loop fasteners, snaps, buttons, or any other device for changing the circumference of the loop 130. In some embodiments the body portions 102 and/or the child carrier portions 106 can be permanently formed into the loop 130. In other embodiments, the body portions 102 and/or the child carrier portions 106 can be selectively coupled with one another to form the loop 130, and in some embodiments can be selectively coupled at different locations to change the circumference of the loop 130.

In some embodiments, a child carrier portion 106 can be integral with and made from the same piece of material as a body portion 102. In alternate embodiments, the child carrier portions 106 can be coupled with the body portions 102 via stitching, adhesives, fusing, or any other coupling mechanism. In some embodiments, the child carrier portions 106 can be comprised of elastomeric material, such that the child carrier portions 106 can conform to a child's body when the child rests on the child carrier portion 106. In other embodiments, the child carrier portions 106 can be comprised of fabric, nylon, fleece, mesh, polymer, plastic, and/or any other desired material or combination of materials. In some embodiments, the child carrier portions 106 can be comprised of hypo-allergenic, anti-bacterial, anti-fungal, waterproof, breathable, sun resistant, and/or water resistant material. The child carrier portions 106 can be machine washable and/or insulated. In some embodiments, the edges of the loop 130 formed by the child carrier portions 106 can be elastomeric. In some embodiments, the child carrier portions 106 can comprise cushions. In some embodiments, the child carrier portions 106 can have holes for a child's legs.

In some embodiments, one or more portions of the loop 130 that can be worn at a user's shoulder can comprise one or more shoulder adjustment mechanisms 134 to change the width of the loop 130 at the user's shoulder. The shoulder adjustment mechanisms 134 can be one or more straps, hook and loop fasteners, buttons, snaps, clasps, elastic cording, or any other device that can change the width of the shoulder portion of the loop 130. In some embodiments, a plurality of shoulder adjustment mechanisms 134 can be selectively mated with one another to decrease the width of the loop 130. In alternate embodiments, one or more shoulder adjustment mechanisms 134 can be operated in isolation to adjust the width of the loop 130. In some embodiments, a plurality of shoulder adjustment mechanisms 134 can be located in different positions around the loop 130, such that the user can choose to wear the loop 130 in different configurations, for example around the user's left shoulder, right shoulder, or both shoulders, and have shoulder adjustment mechanisms 134 near the chosen shoulders regardless of the orientation of the loop 130 around the user's body.

In operation, the convertible bag 100 can be in a closed position such that the child carrier portions 106 are enclosed by the body portions 102 secured together by the closure mechanisms 108, as shown in FIGS. 1 and 2. In the closed position, the user can be able to reach and access items stored in the storage compartments 110, the bottle compartments 116, and/or the pockets 120.

When the user wishes to carry a child, the user can convert the convertible bag 100 to a child carrier by unsecuring the closure mechanisms 108 so that the front and the back of the collapsible bag 100 can be unfolded and arranged substantially side by side such that the child carrier portions 106 are no longer enclosed by the body portions 102. The user can then arrange the child carrier portions 106 into the loop 130 as shown in FIG. 5, and wear the opened convertible bag 100 around the user's torso 602 as shown in FIGS. 6 and 7. In some embodiments, the opened convertible bag 100 can be worn over a user's shoulder in a substantially diagonal fashion, as shown in FIG. 6. In alternate embodiments, the opened convertible bag 100 can be worn on both shoulders, over a user's back, or in any other desired configuration. The user can also choose to remove the handles 122 from the convertible bag 100 and store the handles 122 in a storage compartment 110.

After the convertible bag 100 has been opened and worn on the user's body, the user can place a child 604 on the inside of the loop 130 of the opened convertible bag 100, such that the child's weight rests on the body portions 102 and/or the child carrier portions 106. A user can hold the child 604 in the opened convertible bag 100 in a cradle position, as shown in FIG. 6. In other embodiments, a child 604 may be placed upright against the user's chest, such that the child's buttocks can be supported by the child carrier portions 106 and/or the body portions 102, with the child's feet dangling below the child carrier portions 106, as shown in FIG. 7. In still other embodiments, the child 604 can be placed such that the child's legs are tucked into the loop 130, the child 604 is placed against the user's hips, the child 604 is placed facing forward, the child 604 is placed facing backward, the child 604 is placed sideways, and/or the child 604 is placed in any other configuration. After the child 604 has been placed into the opened convertible bag 100, the user can still be able to reach and access items stored in the storage compartments 110, the bottle compartments 116, and/or the pockets 120.

In some embodiments, one or more breastfeeding covers 606 can be coupled with the loop 130 such that the breastfeeding covers 606 can be placed over the child 604 and/or the user's torso 602 during breastfeeding for the user's privacy, as shown in FIG. 7. In some embodiments, the breastfeeding covers 606 can be integral with the loop 130. In alternate embodiments, the breastfeeding covers 606 can be separate components that can be selectively coupled to the child carrier portions 106 and/or the body portions 102 via fastening components 114.

Figure 8A:
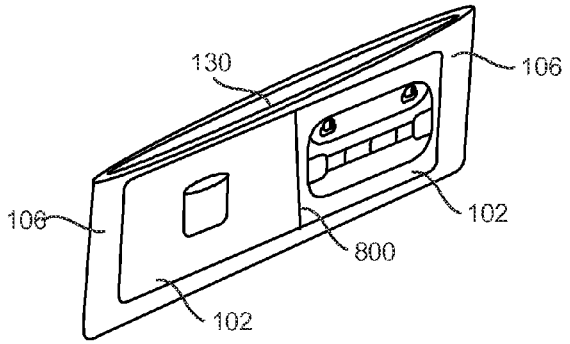
FIGS. 8A-8E depict the steps of a method for converting the convertible bag from an open position to a closed position.
Figure 8B:
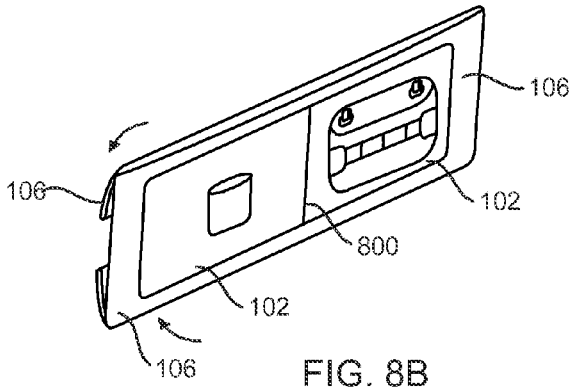
Figure 8C:
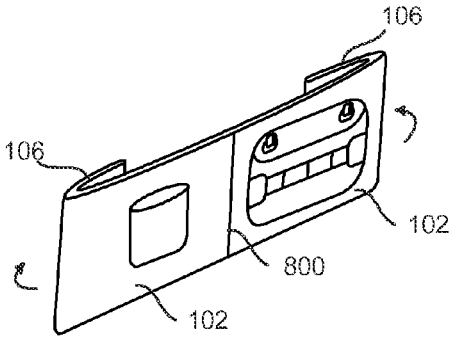
Figure 8D:
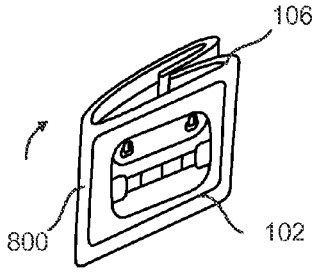
Figure 8E:
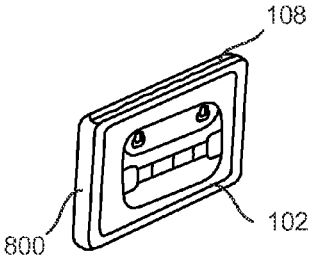

FIGS. 8A-8E depict one embodiment of steps a user can take to return the convertible bag 100 to the closed position. When a user no longer desires to use the convertible bag 100 as a child carrier, the user can remove the child 604 from the opened convertible bag 100. The user can then flatten the loop 130 as shown in FIG. 8A. The user can fold the sections of the child carrier portions 106 that extend above and below the body portions 102 into the loop 130 or behind the loop 130, as shown in FIG. 8B. The user can fold the sections of the child carrier portions 106 that extend to the left and right of the body portions 102, as shown in FIG. 8C. In some embodiments, the child carrier portions 106 and/or the body portions 102 can have corresponding fastening components 114 to secure the folded sections in place after the user folds them into position. The user can fold the body portions 102 and the child carrier portions 106 along the line 800 at which the front and the back of the convertible bag 100 are permanently coupled with one another, as shown in FIG. 8D. The user can then engage the closure mechanisms 108 to secure the remaining sides of the front and the back of the convertible bag with one another such that the child carrier portions 106 are enclosed by the body portions 102, as shown in FIG. 8E. The steps can be reversed to convert the convertible bag 100 from the closed position back to the open position.

Figure 9A:
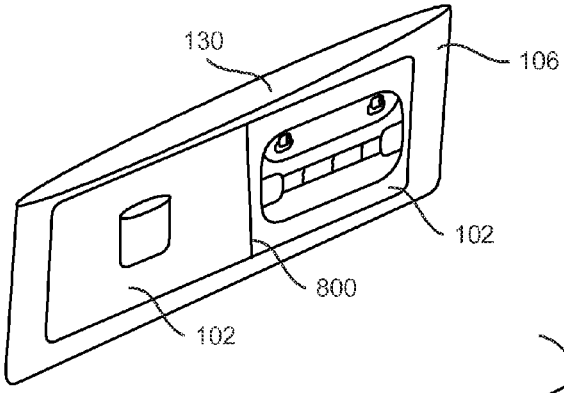
FIGS. 9A-9D depict the steps of another method for converting the convertible bag from an open position to a closed position.
Figure 9B:
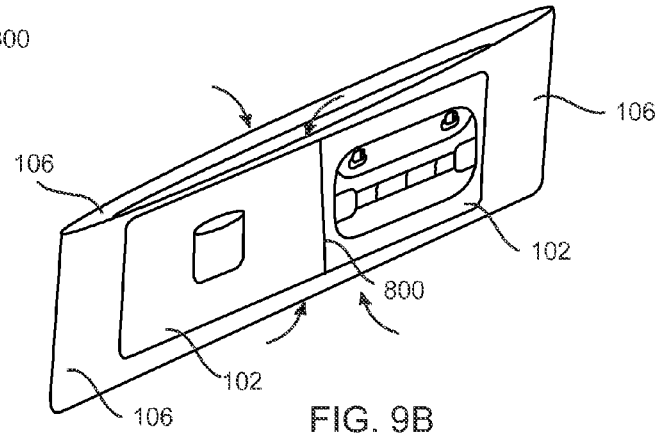
Figure 9C:
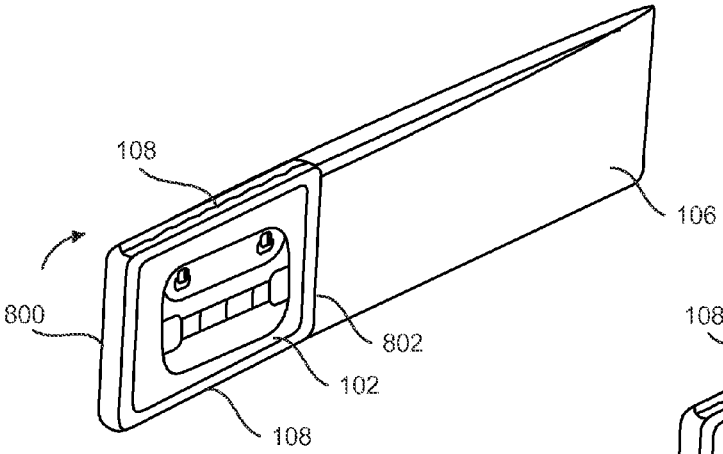
Figure 9D:
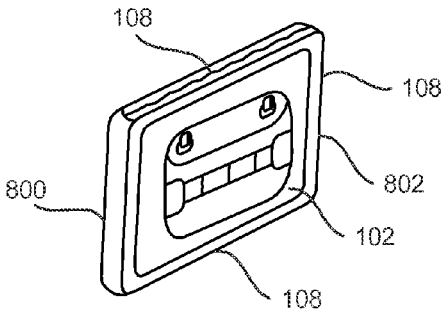

FIGS. 9A-9D depict another embodiment of steps a user can take to return the convertible bag 100 to the closed position. When a user no longer desires to use the convertible bag 100 as a child carrier, the user can remove the child 604 from the opened convertible bag 100. The user can then flatten the loop 130 as shown in FIG. 9A. The user can fold the sections of the child carrier portions 106 that extend above and below the body portions 102 into the loop 130, as shown in FIG. 9B. In some embodiments, the child carrier portions 106 and/or the body portions 102 can have corresponding fastening components 114 to secure the folded sections in place after the user folds them into position. The user can fold the body portions 102 and the child carrier portions 106 along the line 800 at which the front and the back of the convertible bag 100 are permanently coupled with one another, such that the child carrier portions 106 extend outward from the end 802 opposite the line 800, as shown in FIG. 9C. The user can then engage the closure mechanisms 108 to secure the tops and the bottoms of the front and the back of the convertible bag with one another while leaving the side 802 of the convertible bag 100 opposite the line 800 open, as shown in FIG. 9C. The user can then push the child carrier portions 106 through the open side 802 to a position between the body sections 102 and engage the closure mechanisms 108 along the side 802 to enclose the child carrier portions 106 inside the body portions 102, as shown in FIG. 9D. The steps can be reversed to convert the convertible bag 100 from the closed position back to the open position.

In other embodiments, when a user no longer desires to use the convertible bag 100 as a child carrier, the user can remove the child 604 from the opened convertible bag 100 and use any other sequence of steps including tucking, folding, rolling, bending, stuffing, or otherwise manipulating the child carrier portions 106, the body portions 102, and the closure mechanisms 108 to enclose the child carrier portions 106 within the body portions 102 and return the convertible bag 100 to the closed position.

FIG. 10 depicts another embodiment of the convertible bag 100 in which the body portions 102 and/or the child carrier portions 106 can form a front style baby carrier 1000 when the convertible bag 100 is in the open position. The child carrier portions 106 can be one or more support sections 1002. Support sections 1002 can be shoulder straps 1004, back straps 1006, child support sections 1008, and/or any other sections of a front style baby carrier 1000. In some embodiments, the support sections 1002 can comprise additional hardware 1010 that can adjust and/or connect the support sections 1002 together, such as buckles, adjustment rings, clasps, straps, snaps, buttons, or any other desired hardware.

In some embodiments, a child carrier portion 106 can be integral with and made from the same piece of material as a body portion 102. In alternate embodiments, the child carrier portions 106 can be coupled with the body portions 102 via stitching, adhesives, fusing, or any other coupling mechanism. In some embodiments, the child carrier portions 106 can be comprised of elastomeric material, such that the child carrier portions 106 can conform to a child's body when the child rests on the child carrier portion 106. In other embodiments, the child carrier portions 106 can be comprised of fabric, nylon, fleece, mesh, polymer, plastic, and/or any other desired material or combination of materials. In some embodiments, the child carrier portions 106 can be comprised of hypo-allergenic, anti-bacterial, anti-fungal, waterproof, breathable, sun resistant, and/or water resistant material. The child carrier portions 106 can be machine washable and/or insulated. In some embodiments, the child carrier portions 106 can comprise cushions. In some embodiments, the child carrier portions 106 can have holes for a child's legs and/or arms.

FIG. 11 depicts the embodiment of the convertible bag 100 of FIG. 10 in use. When the user wishes to carry a child 604, the user can convert the convertible bag 100 to the front style child carrier 1000 by unsecuring the closure mechanisms 108 so that the front and the back of the collapsible bag 100 can be unfolded and arranged substantially side by side such that the child carrier portions 106 are no longer enclosed by the body portions 102. The user can then arrange the child carrier portions 106 into the support sections 1002 as shown in FIG. 10 and wear the front style child carrier 1000 around the user's torso 602 as shown in FIG. 11. The user can also choose to remove the handles 122 from the convertible bag 100 and store the handles 122 in a storage compartment 110.

After the convertible bag 100 has been opened and worn on the user's body, the user can place a child 604 between the user's torso 602 and the convertible bag 100, such that the child's weight is supported by the body portions 102, the child support section 1008, and or any other support section 1000. In some embodiments, the child's feet can dangle below the front style child carrier 1000, as shown in FIG. 11. The user can place the child 604 into the front style child carrier 1000 such that the child 604 is facing toward the user's torso 602 or facing away from the user's torso 602. After the child 604 has been placed into the front style child carrier 1000, the user can still be able to reach and access items stored in the storage compartments 110, the bottle compartments 116, and/or the pockets 120.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A convertible bag, comprising:

a body portion having a first half and a second half, said body portion being foldable such that said first half and said second half are configured to be folded together to form a pouch bounded by said first half and said second half, said body portion lacking a removable stiffening member that precludes folding said body portion to form said pouch when said removable stiffening member is coupled with said body portion;

one or more storage portions coupled with said body portion; and a child carrier portion extending from all perimeter edges of said body portion beyond the unfolded height and width of said body portion, such that said body portion and said child carrier portion together permanently form a closed loop, said child carrier portion being collapsible such that said child carrier portion is configured to be collapsed and stored within said pouch; and a closure mechanism coupled with said perimeter edges of said body portion, said closure mechanism being configured to seal said pouch around said child carrier portion when said child carrier portion is collapsed, wherein said closed loop forms a child carrier when said child carrier portion is not held within said pouch and is expanded out of its collapsed position, and said first half and said second half of said body portion are not folded together.

2. The convertible bag of claim 1, wherein said child carrier is a sling style child carrier configured to be worn by a user by wrapping said closed loop at least partially around said user's body.

3. The convertible bag of claim 1, further comprising a handle coupled with said pouch such that said closed loop forms a diaper bag with storage inside said one or more storage portions when said child carrier portion is collapsed inside said pouch and said closure mechanism seals said pouch.

4. The convertible bag of claim 1, wherein said one or more storage portions are accessible to a user both when said first half and said second half of said body portion are folded together to form said pouch, and when said closed loop forms said child carrier.

5. The convertible bag of claim 3, wherein said handle is selectively removable and said body portion comprises rings for selectively attaching said handle.

6. The convertible bag of claim 3, wherein said handle is selectively removable and said one or more storage portions comprise rings for selectively attaching said handle.

7. The convertible bag of claim 1, wherein said closure mechanism is a zipper.

8. The convertible bag of claim 1, further comprising one or more bottle compartments coupled with said body portion.

9. The convertible bag of claim 1, further comprising one or more bottle compartments coupled with at least one of said one or more storage portions.

10. The convertible bag of claim 9, wherein said one or more bottle compartments are insulated.

11. The convertible bag of claim 1, further comprising one or more pockets coupled with said body portion.

12. The convertible bag of claim 1, further comprising one or more pockets coupled with the exterior of at least one of said one or more storage portions.

13. The convertible bag of claim 1, further comprising one or more pockets coupled with the interior of at least one of said one or more storage portions.

14. A child carrier, comprising:

a loop having one or more body portions and one or more child carrier portions coupled with all perimeter edges of said one or more body portions and extending beyond the height and width of said one or more body portions, said loop being permanently closed; and a closure mechanism coupled with said perimeter edges of said one or more body portions, wherein said one or more body portions are configured to fold together to form a pouch and said closure mechanism is configured to selectively seal said pouch, wherein said one or more body portions lack a removable stiffening member that precludes folding said one or more body portions to form said pouch when said removable stiffening member is coupled with said one or more body portions, wherein said one or more child carrier portions are collapsible such that they fit within said pouch when said pouch is folded and sealed by said closure mechanism, and wherein said loop is convertible between a first configuration in which said one or more child carrier portions are collapsed and held within said pouch and said pouch is sealed by said closure mechanism, and a second configuration in which said one or more child carrier portions are expanded out of said pouch, said one or more body portions are unfolded, and said loop forms a sling-style child carrier.

15. The child carrier of claim 14, further comprising one or more storage portions coupled with said one or more body portions, such that said loop forms a diaper bag in said first configuration.

16. The child carrier of claim 15, further comprising a bottle compartment coupled with one of said one or more storage portions.

17. The child carrier of claim 16, wherein said bottle compartment is insulated.

18. The child carrier of claim 14, further comprising a removable handle configured to be selectively coupled with said loop when said loop is in said first configuration.

* * * * *